United States Patent [19]

Salger

[11] B 3,995,589

[45] Dec. 7, 1976

[54] DEVELOPING DEVICE FOR ELECTROPHOTOGRAPHIC COPYING MACHINES

[75] Inventor: Werner Salger, Hamburg-Langenhorn, Germany

[73] Assignee: Lumoprint Zindler KG, Hamburg, Germany

[22] Filed: Mar. 31, 1975

[21] Appl. No.: 563,301

[44] Published under the second Trial Voluntary Protest Program on February 17, 1976 as document No. B 563,301.

[30] Foreign Application Priority Data

Apr. 9, 1974 Germany ..... 2417188

[52] U.S. Cl. ..... 118/655; 118/DIG. 24; 427/20

[51] Int. Cl.[2] ..... G03G 15/08

[58] Field of Search ..... 427/20; 355/3 DD; 118/DIG. 24, 637

[56] References Cited

UNITED STATES PATENTS

| | | | |
|---|---|---|---|
| 2,705,199 | 3/1955 | Clark | 118/637 |
| 3,011,474 | 12/1961 | Ulrich | 118/637 |
| 3,062,094 | 11/1962 | Mayo | 355/11 |
| 3,146,688 | 9/1964 | Clark et al. | 118/637 |
| 3,223,548 | 12/1965 | Clark et al. | 427/20 |

*Primary Examiner*—Mervin Stein
*Assistant Examiner*—Douglas Salser
*Attorney, Agent, or Firm*—Toren, McGeady and Stanger

[57] ABSTRACT

A developing device for electrophotographic copying machines using a powder developer avoids the problems associated with a flap-controlled distribution aperture in a hopper holding powder for transfer to an image transfer drum by using a sliding plate-type shutter to control the powder flow. The aperture lies adjacent to the apex of the drum and in a plane inclined to the horizontal. The shutter in its sliding movement is guided against the lower longitudinal edge of the aperture, and the leading edge of the shutter, in its closing movement, moves in an upward path slicing into the powder stream. The shutter is preferably held against the guide of the aperture by the force of spring means acting on the shutter.

9 Claims, 4 Drawing Figures

Fig. 3
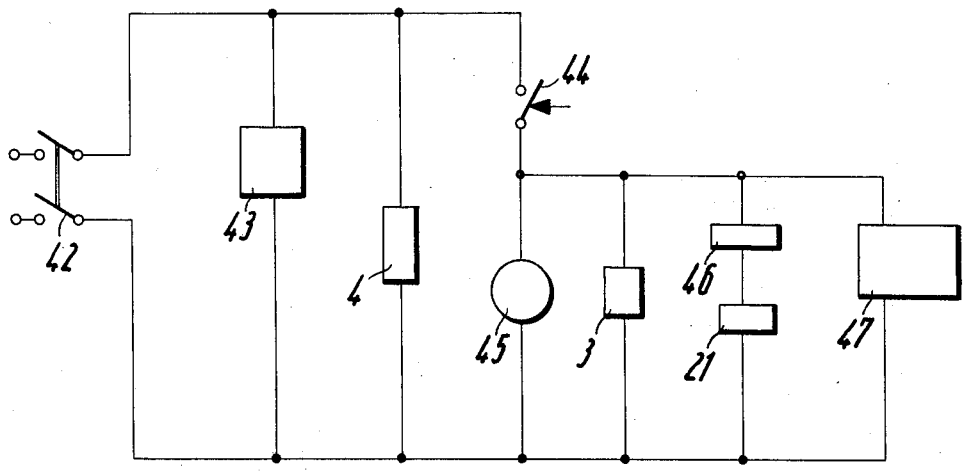
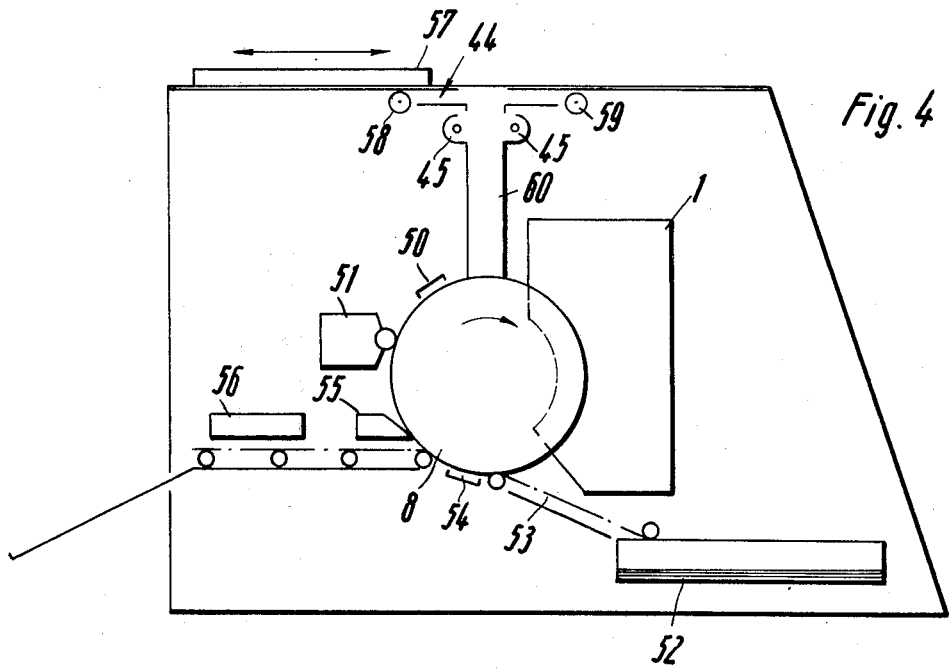
Fig. 4

DEVELOPING DEVICE FOR ELECTROPHOTOGRAPHIC COPYING MACHINES

FIELD OF THE INVENTION

This invention relates to developing devices for electro-photographic copying machines.

The invention is particularly concerned with developing devices which comprise a reservoir for developing powder, and a distribution hopper into which developing powder is carried by a conveyor device and which is provided with a slot-type aperture extending the length of an image transfer element, the aperture lying in a plane set at an angle to the horizontal and arranged to be opened and closed by means of a plate-type shutter which is arranged to be actuated for example by an electromagnetic control device.

DESCRIPTION OF THE PRIOR ART

It is known to use a bucket conveyor or bucket elevator as the powder carrying means in such developing devices. This arrangement is used also in the present invention. In such electro-photographic copying machines it is also common to use as the image transfer element a drum having a sleeve or coating which can be electrically charged and upon which, according to the configuration of a light image directed on to the drum, there is created an appropriate electrostatic charge distribution which can then be made visible by the spreading of developing powder over the surface of the drum.

While it is being illuminated, the drum rotates at a circumferential speed which is the same as the speed of movement of the original which is being copied. The visible image is transferred to copy sheet material by pressing the copy sheet material against the drum, whereafter the powder image is fixed on the copy sheet. The drum itself is then cleaned, again electrostatically charged, and is then ready for exposure to a new light image. The present invention is concerned particularly with a developing device for a copying machine incorporating such a drum, the drum generally being a selenium drum.

One type of developing device is shown in U.S. Pat. No. 3,062,094. In this known arrangement the plate-like shutter is formed as a flap which is hingedly mounted above the upper edge of the aperture of the distribution hopper for pivotal movement and is movable by the action of an electromagnet. The lower edge of the aperture is located on a guide surface which is formed as an extension of one wall of the distribution hopper extending towards this edge of the aperture. The plate-like shutter is so dimensioned that its free end always hinges up against the edge of the guide surface to close the aperture.

With the aperture set at an angle to the horizontal, and in an arrangement incorporating a drum, the aperture lies substantially tangentially above a section of the drum which, with respect to the direction of rotation, follows the apex of the drum, but which is as close as possible to this apex zone, since the scanning of the original takes place in the region of this upper zone. In the known arrangement referred to above, the opening of the flap results in the release of powder in a direction substantially parallel to the plane in which the aperture lies, so that as a result the developing powder falls on a path tangential to the surface of the drum. This adversely affects the adhesion of the power particles to the charged areas of the drum since rebound and reaction forces are produced due to the substantially tangential impact, these reaction forces not being suppressed by the following developing powder particles. The flap movement towards the drum surface also necessitates a comparatively large space between the aperture and the drum, in which connection it is also pointed out that the flap itself always remains in front of the aperture as a deflection surface.

In order to achieve a more favourable application of the developing powder, it is known from German published patent application No. 2,225,095 to provide a so-called developing crown on the drum beneath a permanently open aperture of a distribution hopper. However, this developing crown requires a large powder throughput and consequently an expensive supply of developing powder into the device, as well as the fact that such a developing crown can create certain frictional effects if the aperture of the distribution hopper is close to the drum. It is particularly disadvantageous if the developing powder is composed of toner and carrier particles, since carrier particles entrained by the toner then produce the above-mentioned friction effects. In addition, with this arrangement, a positioning of the developing device adjacent to the apex of the drum is not readily possible, since at the section of the drum whicn is higher with reference to the position of the aperture, there must be provided a developing powder barrier, for example in the form of a seal, preferably a skin-type seal.

From German published patent application No. 2,232,950 it is known to define the lower edge of an aperture in a distribution hopper by a baffle and to use magnets as latch means in order to control the flow of developing powder through the aperture. Apart from the fact that this form of control is uncertain, since the magnetic flux lines between adjacent magnets are curved and consequently do not present constant conditions over the entire length of the aperture, there is also the fact that a pre-charging of the developing powder and of the carrier particles is brought about or at any rate influenced by these magnetic latch devices and also by the electrostatic charge on the drum. The baffle surface acts as a slipway so that a damming up of powder on the drum must be accepted.

With reference to the above-mentioned known arrangements, particularly with regard to the flap control, it is to be noted that these arrangements do not operate with short time constants in respect of the opening and closing times, so that on the one hand it is not possible to achieve a high copying speed or a rapid series of copies, and on the other hand one is faced with considerable dirtying of the drum surface.

It is also known, in a so-called "Statikon" machine to form a vertical wall adjacent to the drum at the upper region of the drum as a slide which is movable in a vertical plane and which can be drawn upwardly in order to free a powder distribution aperture. In its closing movement this slide is pushed down from above into the developing powder stream with the result that on the one hand one cannot ensure absolute certainty of shutting off of the powder supply since developing powder particles can become jammed between the free end of the slide and the lower edge of the vertical aperture, and on the other hand the ejection position of the developing powder is comparatively far from the apex of the drum so that anyhow one can only achieve a tangential powder path in a substantially vertical direction. Moreover, comparatively complex guide means for the slide are necessary in order to maintain it in its vertical plane. Such an arrangement is only suitable for low copying speeds when it is then possible to achieve a sufficient adherence of toner to the drum surface.

SUMMARY OF THE INVENTION

It is an object of the present invention to provide an improved form of developing device of the type first mentioned above, in which the shutter functions with a small time constant both in its opening movement and also in its closing movement, in which the aperture is arranged both close to the apex of the drum and also close to the circumference of the drum, with a particularly reliable closure being achieved without danger of the jamming of powder particles in the shutter, and in which also the distribution of the developing powder on to the circumference of the drum is effected in a direction substantially radially of the drum surface without this direction being affected in any way by the plate-like shutter.

In accordance with the present invention there is provided a developing device for electro-photographic copying machines, comprising a developing powder reservoir, a distribution hopper into which developing powder is carried by conveyor means, said hopper defining a slot-type aperture which extends over at least the axial length of an image transfer element to which powder is to be transferred and which lies in a plane inclined at an angle to the horizontal, and a plate-type shutter which is arranged to be moved under the control of an actuating means between open and closed positions in relation to said aperture, said shutter being slidably movable and in its movement being guided against the lower longitudinal edge of the aperture, and the leading edge of the shutter being arranged to move in an upward path in its closing movement.

By dispensing with a flap and by using a plate-type sliding shutter the angled setting of the aperture remains the determining factor for the direction of ejection of the powder, and the guidance of the shutter against the lower longitudinal edge of the aperture also makes it possible for the aperture to be positioned comparatively close to the apex of the image transfer element, i.e. the drum. The formation of the shutter as a sliding member also makes it possible for it to be positioned close to the drum surface, with the result that in general the closing movement at an upward angle effects a particularly good blocking of the aperture, since the developing powder primarily dams up in the upwardly open angle formed between the wall defining the lower edge of the aperture and the sloping, upwardly-directed plate-like shutter.

It is preferable if the shutter is hingedly connected to pivot lever means which includes a rotatable shaft controlled by said actuating means. In this way one achieves a combination in which the shutter is not guided rigidly in its direction of movement but is pivotally coupled, with the rotatable shaft being movable relative to the lower edge of the aperture.

Preferably, the lower longitudinal edge of the aperture acts as a guide edge for the shutter, the shutter being held against the guide edge under pressure during its sliding movement and being arranged to pivot about this guide edge in accordance with the position of support means, e.g. pins, displaceable relative to the guide edge, the shutter being hingedly mounted on these pins. In this way an automatic wiping movement for developing powder in the region of the guide edge is achieved so that a reliable shutting off of powder in the closing movement is ensured.

According to a preferred feature of the invention the shutter is guided against the lower longitudinal edge of the aperture and in dependence upon the movement of the pivot lever means in the closing movement executes an upwardly directed slicing movement into the developing powder stream in combination with a pivotal movement, by means of which movements the shutter is pivoted from a relatively steeply inclined open position into a less steeply inclined end position in which it lies in closed engagement with an abutment strip at the upper edge of the aperture.

Preferably, this abutment strip is provided beneath a step at the outer side of the aperture in the distribution hopper.

According to a further preferred feature of the invention, the shutter is held against the lower longitudinal edge of the aperture under the force of spring means which extend between support means on the rotatable shaft and the shutter itself. A certain elasticity is thus achieved thereby.

Preferably, the slide-type shutter is formed as a double-armed lever, and co-operates on the one hand with the edges of the aperture and on the other hand with at least one compression spring. The lever is flat, and the portion thereof which co-operates with the compression spring or springs acts itself as a sliding surface for developing powder in the event that any developing powder passes through beneath the guide edge. This is practically excluded however since the plate-type shutter is drawn down at an angle, and indeed with a pivotal movement of the shutter such that it pivots about the edge of the aperture in the retraction movement and consequently the delivery of developing powder takes place in a direction radially towards the drum. The guide edge of the aperture may be rounded.

BRIEF DESCRIPTION OF THE DRAWINGS

In order that the invention may be fully understood, a preferred embodiment in accordance therewith will now be described in detail by way of example and with reference to the accompanying drawings. In the drawings:

FIG. 3 is a schematic circuit diagram of an operational circuit for a copying machine; and, FIG. 4 is a schematic side view of an electrophotographic copying machine to explain the interrelationship of the developing device of the present invention with the other machine components.

DESCRIPTION OF THE PREFERRED EMBODIMENT

Figure 1:
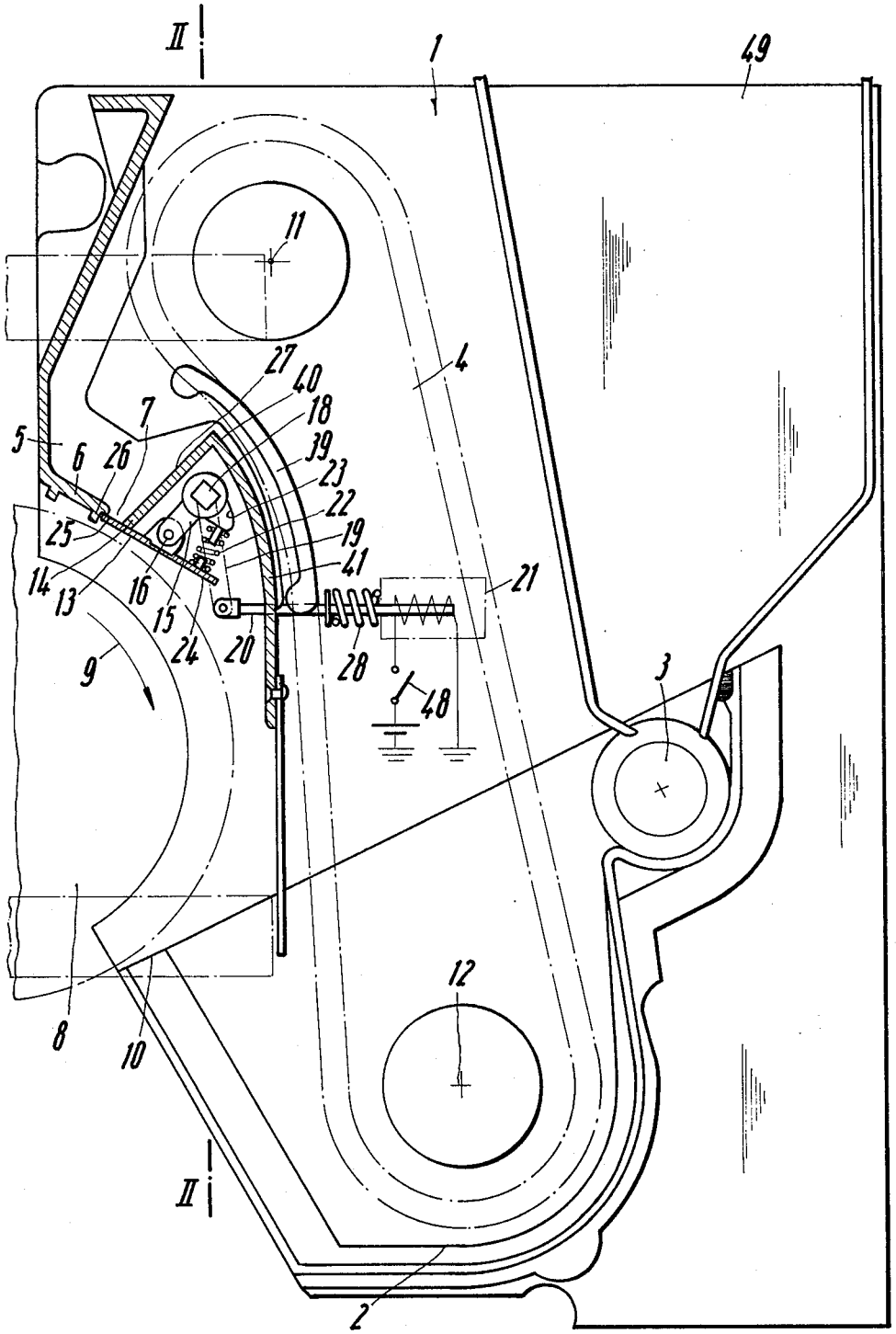
FIG. 1 is a schematic side view of a developing device in accordance with the invention showing the components essential to the invention but with the other parts omitted.

The developing device which is indicated generally at 1 includes a reservoir 2 for a developing powder in its lower region. The supply of powder in this reservoir 2 can be continuously replenished from a source (not shown) by means of a rotating feed device 3. For example, a stock of powder may be located in a storage chamber 49 above the rotatable feed device 3. A conveyor device 4 in the form of a bucket conveyor or elevator circulates through the powder in the reservoir 2, scooping developing powder from the reservoir and ejecting it into a channel-shaped distribution hopper 5. The channel-shaped hopper 5 has a sloping lower wall 6 which terminates at the upper edge of an aperture 7 which lies in an inclined plane. The lower edge 14 of the inclined aperture 7 is defined by the bottom edge of another sloping lower wall 27 of the hopper. This inclined plane lies tangentially to the surface of a drum-type cylinder 8 having a sleeve of electrostatically chargeable material on which, after the charging of the sleeve and after the exposure of an original to scanning illumination and the transmission of the light image to the drum there is created an electrostatic charge distribution corresponding to the image to be produced and developed by the developing powder. The drum 8 is driven for example in the direction of the arrow 9. The transmission of the light image to the drum surface takes place in the region of the apex of the drum, adjacent to which the developing device 1 is positioned. The downwardly moving peripheral surface of the drum 8 passes between side walls of the developing device beneath the aperture 7, so that developing powder released on to the drum, insofar as it is not attracted to the drum, returns to the reservoir 2 which has an edge 10 thereof extending beneath the drum. The conveyor device 4 is mounted on two supporting shafts 11 and 12, one of which shafts 11 has a driving mechanism associated therewith which is positioned co-axially with respect to the shaft 11 and thus belongs to the conveyor device. The opening of the aperture 7 is controlled by a plate-like shutter 13 which is shown in FIG. 1 in its closed position. This plate-like shutter 13 extends over the whole length of the aperture 7 which is at least equal to the axial length of the drum 8. The platelike shutter 13 lies outside the aperture 7. It is hingedly mounted by means of pins 16, 16' from pivot lever mechanisms 15, 15' so that it closes against the lower longitudinal edge 14 of the aperture. Several pivot levers 15, 15' may be provided for example along the length of the aperture 7 in the direction perpendicular to the plane of FIG. 1 of the drawings. These pivot levers 15, 15' are mounted for fixed rotation with a rotatable shaft 18. This rotatable shaft 18 extends out through side walls 29, 30 of the developing device extending parallel to the plane of FIG. 1 of the drawings. A crank arm 19 is connected to one end of the shaft 18 outside the side wall of the developing device and is hingedly connected at its other end to the armature rod 20 of an electromagnetic actuator 21. When this electromagnetic actuator 21 is energised by closure of a switch 48 the pivot lever mechanisms 15, 15' pivot in the counter-clockwise direction as viewed in FIG. 1 so that the aperture 7 is opened by the plate-like shutter 13 being drawn down at an angle. Thus, the pins 16, 16' move on an arc of a circle centred on the rotatable shaft 18. By this, there takes place a positional change of the pins 16, 16' in their orientation relative to the lower longitudinal edge 14 of the aperture 7, which edge is shown as a guide edge, with the result that the plate-like shutter 13 is pivoted about this guide edge 14. The lower end of the guide edge 14 can be rounded off to facilitate this movement. The maintenance of the engagement of the plate-like shutter 13 against the guide edge 14 is ensured by the provision of at least one spring 22, 22' which at its one end is connected to a support lug 23, 23' arranged for fixed rotation with the rotatable shaft 18 and which at its other end is connected to a section 24 of the shutter 13. With the arrangement of the spring 22 as a compression spring, the plate-like shutter 13 operates as double-armed lever. This arrangement is advantageous since in this way one achieves a compact layout of the aperture 7 adjacent to the apex of the drum and additionally the section 24 of the shutter 13 acts as a slipway for any developing powder which may escape past the guide edge 14. However, by virtue of the direction of movement of the sliding shutter 13 and the pressure at the guide edge 14 due to the springs 22, 22', with the illustrated orientation of the parts relative to one another, no escape of developing powder past the guide edge 14 need be feared. A reliable closing off of the aperture 7 is achieved for the rest if a marginal strip 25 at the upper longitudinal edge of the aperture 7, against which the sliding shutter 13 registers, is provided below a step 26 at the external side of the aperture 7. In this respect it is pointed out that, in contrast to a flap-type shutter, the shutter 13 of the present invention, in its closing movement into its position beneath the step 26, moves throughout in a somewhat flatter attitude than is the case with the upward movement of a flap into the stream of developing powder, which in the present invention flows substantially radially of the drum 8 along the line of the wall 27.

It will be seen that a return spring 28 is provided in the electromagnet 21. This spring 28 is preferably effective for the closing movement of the shutter. By appropriate dimensioning of the crank arm 19 the transmission of movement can be carried out most effectively and yet in a very small space.

The conveyor device 4 operates in the usual way. The side chains between which the conveyor buckets are positioned are guided on a curved track in the region of the channel-shaped hopper 5 over curved conductor rails 39 at each side, so that a satisfactory release of powder into the channel-shaped hopper is possible. From the bottom wall 40 of the hopper 5 there extends a downwardly projecting wall 41 over which the downwardly moving section of the conveyor device 4 passes. This wall 41 separates the conveyor device 4 of the developing unit from the separate shielded means for moving the shutter for the aperture 7. These shielded parts thus lie in a protected position between walls of the unit and are also protected underneath, i.e. in the direction towards the drum 8, by the plate-like construction of the shutter 13.

Figure 2:
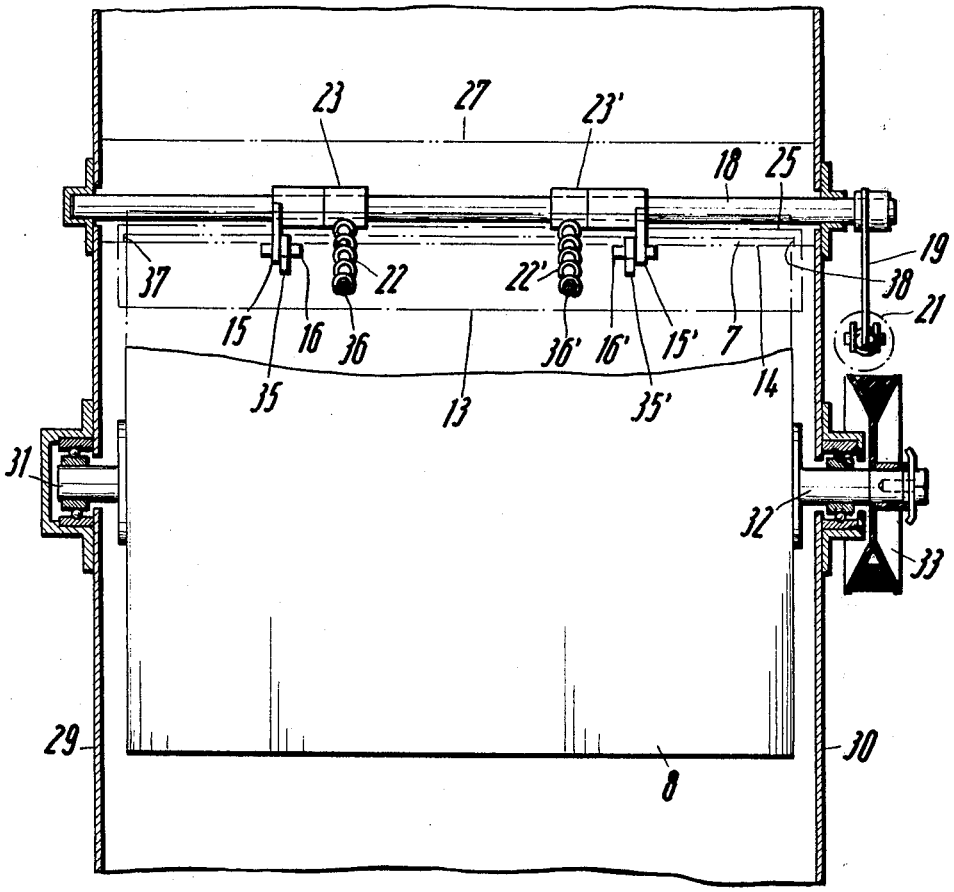
FIG. 2 is a partial sectional view taken along the line II—II of FIG. 1.

In FIG. 2 there is shown the side walls 29 and 30 between which the developing unit is positioned and in which the drum 8 is mounted in known manner by means of stub shafts 31 and 32 at opposite ends of the drum. The stub shaft 32 is arranged to extend through the side wall 30 and is provided at its outer end with drive means 33. Furthermore, the rotatable shaft 18 is also mounted in the side walls 29, 30 for rotation. At its right-hand end as viewed in FIG. 2 the rotatable shaft 18 projects outwardly through the side wall 30 and is there connected to the crank arm 19. The projecting end 34 of the shaft 18 may for example be of square cross-section to provide for a satisfactory seating of the crank arm 19 thereon.

Two pivot levers 15 and 15' are shown connected to the rotatable shaft 18 for fixed rotation therewith, and their free ends are hingedly secured by respective brackets 35 and 35' to the plate-like shutter 13. In addition, two bearing supports 23 and 23' for the springs 22 and 22' are arranged on the rotatable shaft 18 for fixed rotation therewith. Abutments 36 and 36' are arranged on the platelike shutter 13 to act as seats for one end of each of the springs 22 and 22' in order that the position of the springs against the shutter is maintained. It can also be seen from the drawing that the longitudinal edge 14 of the aperture 7 is at the lower edge of the wall 27. This wall 27 extends laterally to the side walls 29 and 30. Next to the side walls and in the region of the aperture 7 there are provided inwardly projecting sections 37 and 38 which define the side edges of the aperture 7. In this way the plate-like shutter can move with freedom from the side walls 29 and 30, although the axial length of the aperture 7 is chosen so that it is at least equal to the length of the drum 8.

FIG. 3 is a schematic diagram showing one form of drive circuit for an electro-photographic copying machine. The mains electrical supply is made available to the circuit through a switch 42. When this switch 42 is closed a component group 43 is switched on, this group comprising various machine components not relevant to the present invention, such as for example the drive for the drum 8, a cooling fan, cleaning means for the drum, feed means for the supply of copy sheets, and possibly also feed means for the guidance of an original to be copied as it moves in its predetermined path during exposure to the scanning light source. The mains switch 42 also energises the conveyor device 4 so that it is therefore made quite certain that the distribution hopper 5 will be filled with developing powder.

By means of a trip switch or a switch unit 44 positioned in the path of an original to be copied, a source of illumination 45, the powder feed device 3, and, possibly by the switching on of a time delay mechanism 46, the electromagnet 21, are all switched on for the production of a copy. The time delay mechanism 46 ensures not only the correct time of opening of the shutter in dependence upon actuation of the switch 44, but also ensures that the electromagnet 21 is energised for a sufficient time. Also in dependence upon the actuation of the switch 44, other devices not relevant to the present invention are actuated, these being symbolized in FIG. 3 by the block 47. This block 47 may include, for example, the electrostatic charging device for the drum; possibly additional charging devices for the transference of the image; means for wiping residual powder from the drum; a copy sheet withdrawal device arranged to act on the sheets in a copy sheet stack for the purpose of feeding single copy sheets at the correct cycle times to the drum; and control means for a fixing or fusing device through which the copy sheets are arranged to pass after the image transfer process.

FIG. 4 shows the general positioning of the developing unit 1 within the electro-photographic copying machine. This machine uses as an image transfer element the drum 8 which is driven in the direction of the arrow shown in the drawing. This drum 8 is illuminated with light from light sources 45 after it is reflected from the original to be copied through appropriate optical means within a light tunnel 60, with the result that the image of an original which is moved in reciprocating manner over the top of the machine by means of a carriage 57 is transferred to the surface of the drum. Drive rollers for the carriage 57 are indicated at 58 and 59.

In advance of the light tunnel 60, viewed in the direction of rotation of the drum, there is provided an electrostatic charging device 50 and, before this, a cleaning device 51. The developing unit 1 is arranged subsequent to the light tunnel 60 in the direction of rotation of the drum. Beneath the developing unit 1 there is provided a supply 52 of copy sheets which are fed by guide means along the path indicated by the broken line 53 in synchronism with the operating cycle of the drum 8 in order to transfer to the copy sheets the developed image. This transfer may be assisted by a discharge device 54. The feed path for the copy sheet material extends beneath a fusing station 56 and then to a delivery tray of the machine. A blade is shown at 55 which serves to facilitate the removal of the copy sheet material from the surface of the drum 8. These various components are only shown schematically as both the components themselves and also their functions are well known.

I claim:

1. A developing device for electro-photographic copying machines, comprising a developing powder reservoir, a distribution hopper, a supply of developing powder in the lower region of the developing powder reservoir, said distribution hopper being positioned at a higher level than the developing powder supply, conveyor means to move through the developing powder reservoir and to carry developing powder from the supply to the distribution hopper, means defining a slot-type aperture in the distribution hopper a rotatable image transfer element below the aperture, said aperture extending over at least the axial length of said image transfer element with upper and lower longitudinal edges lying in a plane inclined at an angle to the horizontal, a plate-type shutter co-operable with the aperture and mounted for sliding movement in order selectively to close and open said aperture, control means coupled to the shutter for effecting movement thereof, support means arranged between the control means and the shutter, said support means being provided at the side of the lower longitudinal edge of the aperture, said longitudinal edge forming a guide means for the sliding shutter, and the leading edge of the shutter in the closing movement of the shutter moving in an upwards path.

2. A device as claimed in claim 1, in which said support means comprises pivot lever means which includes at least one pivot pin on which the shutter is pivotally hinged, said pivot lever means being connected to a rotatable shaft, said control means being coupled to said rotatable shaft, and spring means acting on said pivotally mounted shutter to urge the shutter against the lower longitudinal edge of the aperture.

3. A device as claimed in claim 2, in which the lower longitudinal edge of the aperture which acts as a guide edge for the sliding shutter and the rotatable shaft are mounted in fixed spatial relationship, and in which said at least one pin in the closing movement of the pivot lever means moves in relation to the lower longitudinal edge of the aperture in a direction perpendicular to the inclined plane in which the aperture lies.

4. A device as claimed in claim 3, in which an abutment strip is provided along the upper edge of the aperture, and in which the rotatable shaft lies in a plane above the aperture, and the shutter in dependence upon the movement of the pivot lever means in the closing movement executes an upwardly directed slicing movement into the developing powder stream in combination with a pivotal movement, by means of which movements the shutter is pivoted from a relatively steeply inclined open position into a less steeply inclined end position in which it lies in closed engagement with the abutment strip.

5. A device as claimed in claim 4, in which said abutment strip is provided beneath a step at the external side of the aperture in the distribution hopper.

6. A device as claimed in claim 2, in which a bearing support is provided on the rotatable shaft, one end of said spring means being secured to this bearing support and the other end of the spring means being connected to the shutter.

7. A device as claimed in claim 6, in which the shutter is hingedly connected to the pivot lever means substantially midway between its upper and lower longitudinal edges and is formed as a double-armed lever plate, one arm of which on one side of the hinged connection co-operates with the edges of the aperture and the other arm of which on the other side of the hinged connection co-operates with said spring means.

8. A device as claimed in claim 3, in which the lower longitudinal edge of the aperture forming the guide edge for the shutter is rounded and the shutter in its movement pivots about this rounded edge.

9. A developing device for electro-photographic copying machines, comprising a developing powder reservoir, a distribution hopper into which developing powder is carried by conveyor means, said hopper defining a slot-type aperture which extends over at least the axial length of an image transfer element to which powder is to be transferred and which lies in a plane inclined at an angle to the horizontal, and a plate-type shutter which is arranged to be moved under the control of an actuating means between open and closed positions in relation to said aperture, said shutter being slidably movable and in its movement being guided against the lower longitudinal edge of the aperture, and the leading edge of the shutter being arranged to move in an upward path in its closing movement.

* * * * *